US010266927B2

(12) United States Patent
Prunier

(10) Patent No.: US 10,266,927 B2
(45) Date of Patent: Apr. 23, 2019

(54) ALLOY, CORRESPONDING PART AND MANUFACTURING METHOD

(71) Applicant: FERRY CAPITAIN, Vecqueville (FR)

(72) Inventor: Jean-Baptiste Prunier, Joinville (FR)

(73) Assignee: FERRY CAPITAIN, Vecqueville (FR)

( * ) Notice: Subject to any disclaimer, the term of this patent is extended or adjusted under 35 U.S.C. 154(b) by 613 days.

(21) Appl. No.: 13/947,735

(22) Filed: Jul. 22, 2013

(65) Prior Publication Data

US 2014/0023548 A1 Jan. 23, 2014

(51) Int. Cl.
*C22C 37/04* (2006.01)
*C22C 37/10* (2006.01)

(52) U.S. Cl.
CPC ..... *C22C 37/04* (2013.01); *C22C 37/10* (2013.01)

(58) Field of Classification Search
CPC ..... C22C 37/04; C22C 37/10
See application file for complete search history.

(56) References Cited

U.S. PATENT DOCUMENTS

| | | | | |
|---|---|---|---|---|
| 4,435,226 | A | 3/1984 | Hans et al. | |
| 5,082,507 | A | 1/1992 | Curry | |
| 2011/0017364 | A1 | 1/2011 | Junyoung et al. | |
| 2011/0094632 | A1* | 4/2011 | Pelsoeczy | C21D 5/00 148/324 |

FOREIGN PATENT DOCUMENTS

| | | | |
|---|---|---|---|
| CN | 1043754 | A * | 7/1990 |
| EP | 1 566 459 | A2 | 8/2005 |
| EP | 1 566 459 | A3 | 6/2007 |
| JP | 61133361 | A * | 6/1986 |
| WO | 99/19525 | A | 4/1999 |
| WO | 2011/157840 | A1 | 12/2011 |

OTHER PUBLICATIONS

Elliott, Roy. "An Introduction to Cast Irons." Cast Iron Technology. London: Butterworths, 1988. 9. Web. Nov. 27, 2015.*

Kobayashi, Toshiro, and Hironobu Yamamoto. "Development of High Toughness in Austempered Type Ductile Cast Iron and Evaluation of Its Properties." MTA Metallurgical Transactions A 19.2 (1988): 319-27. Springer. Web. Nov. 25, 2015.*

Notification of Patent Examination Report No. 1 from Australian Government dated Feb. 13, 2015 in Australian Application No. 2013204216.

Preliminary Patentability Report dated Mar. 28, 2013 for French Application No. FR1257099.

ASTM A536 80-55-06 Ductile Iron, SG Iron, Chemical Composition, Mechanical and Physical Properties; http://www.iron-foundry.com/astm-a536-80-55-06-ductile-iron.html; 2 pages; Printed on Sep. 15, 2016.

Annex E—Classification as a function of hardness; http://foundry.jp/bukai/wp-content/uploads/2013/03/9f2926aec2259c8ce48a03b69308a3fa.pdf; 1 page; Printed on Nov. 14, 2016.

European Search Report, dated Dec. 17, 2015, in Application No. EP 13 17 6453.

* cited by examiner

*Primary Examiner* — Colleen P Dunn
*Assistant Examiner* — Jeremy C Jones
(74) *Attorney, Agent, or Firm* — Knobbe, Martens, Olson & Bear, LLP

(57) ABSTRACT

A spheroidal graphite cast iron alloy comprises, in % by weight, in addition to addition elements, the following elements:

Ni between 3.5% and 7%,
Cu between 0.5% and 3%,
Mo between 0.15% and 1%,
the remainder being iron and inevitable impurities.

The spheroidal graphite cast iron alloy may be used in manufacturing a part such as cogwheels and gear rims. The method of manufacturing the part may comprise casting a rough casting blank, notably into a mold, and letting the rough casting blank cool in the mold, thus obtaining the part.

27 Claims, No Drawings

ALLOY, CORRESPONDING PART AND MANUFACTURING METHOD

CROSS-REFERENCE TO RELATED APPLICATIONS

This application claims the benefit of French Application No. 12 57099 filed Jul. 23, 2012, which is hereby expressly incorporated by reference in its entirety.

BACKGROUND OF THE INVENTION

Field of the Invention

The present invention relates to a spheroidal graphite cast iron alloy.

Description of the Related Art

In the state of the art, gear rims are known which for example are used for transmitting a drive torque to a milling machine. These rims are in spheroidal graphite cast iron or in steel.

In the state of the art, spheroidal graphite cast iron gear rims are calculated either according to the AGMA 6014 (6114 respectively) standard or according to the ISO 6336 standard.

According to the ISO 6336 standard, the maximum admissible stresses are given according to the curves of part 5 of this same standard, curves of $\sigma_{Hlim}$ (pressure stress) and $\sigma_{Flim}$ (root flexural stress of the gear tooth), versus hardnesses. The higher the hardness, the higher are the maximum admissible stresses and therefore the larger is the power which may be transmitted by the gear rim.

In present curves from ISO 6336, the hardness range extends up to 300HB, the produced grades are according to the EN 1563 standard—spheroidal graphite cast iron grades—in which grades with a tempered ferritic, pearlitic and martensitic matrix are only taken into consideration.

For calculations according to the AGMA 6014 (6114 respectively), references are made to the material standards ASTM A536 and ISO 1083. The curves giving admissible stresses versus hardness are given up to about 340HB. But for high hardnesses, there are no corresponding grades in the standards.

The present cast iron grades give the possibility of obtaining at best hardnesses of 320HB on gear rims. For very large powers, they reach their limit of use and presently the only solution is to change the material by passing to cast steel. The 320HB hardnesses of present cast irons are obtained by quenching followed by tempering.

There also exist grades according to EN 1564—spheroidal graphite cast iron grades obtained by staged quenching, so-called ADI cast irons—for which the values of $\sigma_{Hlim}$ and $\sigma_{Flim}$ are also defined depending on hardness intervals. Staged quenching is achieved in a bath of salts. In order to produce gear rims, it will be necessary to be equipped with pans of large dimensions.

SUMMARY OF THE INVENTION

The object of the invention is to give the possibility of manufacturing a cast iron part, for which transmissible power is significant. In particular, the object of the invention is to give the possibility of manufacturing a cast iron part, such as a gear rim, notably of large size, in spheroidal graphite cast iron. The goal is to develop an alloy grade which attains these criteria in particular with simple and economical heat treatment means.

DETAILED DESCRIPTION OF THE PREFERRED EMBODIMENT

For this purpose, the object of the invention is an alloy.

According to particular embodiments, the alloy includes one or more of the features.

The object of the invention is also a part manufactured in an alloy as described above.

The invention also relates to methods for manufacturing a part.

The invention will be better understood upon reading the description which follows, only given as an example.

The object of the invention is a spheroidal graphite cast iron alloy. It gives the possibility of obtaining high hardnesses and therefore high admissible stresses, notably on large size parts.

The part for example is a cogwheel or a gear rim or a gear wheel or a gear crown. The part is preferably a part of a large dimension, i.e. having the largest dimension of the part of at least 2,000 mm. Preferably, the part has an outer diameter of at least 2,000 mm, or of at least 3,000 mm, or of at least 6,000 mm. The axial thickness, generally the width of the teeth, the largest of the part is for example of at least 150 mm, or of at least 250 mm, or of at least 550 mm. A gear rim according to the invention has a rim thickness of at least 80 mm or of at least 120 mm or of at least 150 mm and a modulus of at least 10 or of at least 16 or of at least 22 or of at least 25.

Preferably, the high hardness is obtained with a tempering heat treatment. The hardness depends on the composition of the alloy and optionally on various heat treatments which the part undergoes during its elaboration, whether this be during cooling after casting or during subsequent ovenings.

All the indications are subsequently given in % by weight of the total weight.

A first aspect of the invention is the chemical composition of the alloy.

The alloy is cast iron with spheroidal graphite.

Its basic composition is iron, addition elements and inevitable impurities. The addition elements are carbon (C), silicon (Si), and magnesium (Mg). The element which forms the remainder of the alloy is therefore iron (Fe).

Generally, the alloy comprises, in addition to the basic composition, nickel (Ni) between 3.5% and 7%, copper (Cu) between 0.5% and 3% and molybdenum (Mo) between 0.15% and 1%.

Further, the alloy may comprise manganese (Mn) up to 1% or up to 0.8%.

Further, the alloy may comprise chromium (Cr) up to 0.4%.

Further, the alloy may comprise carbon (C) between 2.5% and 4% and silicon (Si) between 1.5% and 4.4%.

The nickel (Ni) content of the alloy may be at least 3.5%, 4%, 4.1%, 4.2%, 4.3%, 4.4%, 4.5%, or 4.8% and at most 7%, 6.5%, 6%, or 5.8%.

The molybdenum (Mo) content may be comprised between at least 0.15%, 0.25%, or 0.3% and at most 1%, 0.8%, or 0.5%.

The copper (Cu) content may be comprised between at least 0.5%, 1%, or 1.5%, or at most 3%, 2.5%, or 2.2%.

It is to be noted that the low limits and high limits of the above contents are independent one from another. The Nickel content can therefore be for example comprised between 4.4% and 7%.

The carbon (C) content may be comprised between 3% and 3.6%.

The silicon (Si) content may be comprised between 1.8% and 2.4%.

The chromium (Cr) content may be less than 0.2%.

The manganese (Mn) content may be greater than 0.2%.

The alloy according to the invention can consist of the above elements, whereby manganese (Mn), and/or chromium (Cr) and/or phosphorus (P) and/or sulfur are/is optional element/s or present in traces.

According to the example, the alloy comprises in addition to iron (Fe) and inevitable impurities, the following elements, within the limits shown:

| | C | Si | Ni | Mo | Cu | Mn | Cr | Mg | P | S |
|---|---|---|---|---|---|---|---|---|---|---|
| Min. | 2.5 | 1.5 | 3.5 | 0.15 | 0.5 | | | 0.02 | | |
| Max. | 4 | 4.4 | 7 | 1 | 3 | 1 | 0.4 | 0.1 | 0.04 | 0.015 |

The heat treatment consists of tempering. It is a bulk heat treatment, it gives the possibility of obtaining the desired hardness and indicated above over the whole thickness of the part. The hardness therefore does not extend over only a few millimeters at the surface.

The part is then machined, notably by turning and in the case of a gear rim, the teeth are cut.

The HB hardness of the alloy according to the invention and notably of the spheroidal graphite cast iron is comprised between 320HB and 400HB. The part in this alloy thus gives the possibility of transmitting very great powers.

The obtained metallographic structure of the alloy consists of 90% of nodules of type VI or V (according to EN ISO 945-1) and of a bainitic matrix which may include residual austenite (up to 10%), carbides (up to 5%), tempered martensite (up to 5%) and pearlite (up to 20%).

The obtained characteristics on a cast sample, side by side, are the following:

| | | Mechanical properties | | | | |
|---|---|---|---|---|---|---|
| Sample | Thickness (mm) | Ultimate tensile strength (MPa) | Min. 0.2 yield strength (MPa) | Min. elongation (%) | Ultimate foot fatigue strength $\sigma_{Flim}$ (N/mm$^2$) | Ultimate flank fatigue strength $\sigma_{Hlim}$ (N/mm$^2$) |
| Sample 1 (Type HB 320) | ≥80 | 850 | 570 | 1 | 256-330 | 730-840 |
| Sample 2 (Type HB 330) | ≥80 | 860 | 580 | 1 | 259-306 | 745-855 |
| Sample 3 (Type HB 340) | ≥80 | 880 | 600 | 1 | 263-310 | 760-870 |
| Sample 4 (Type HB 350) | ≥80 | 890 | 610 | 1 | 267-314 | 775-885 |
| Sample 5 (Type HB 360) | ≥80 | 910 | 630 | 1 | 271-318 | 790-900 |

As an example, the hardness that can be obtained with the alloy according to the invention is indicated in the following table, as a function of the chemical composition, other than the basic composition.

| | Ni | Mo | Cu | C | Si | Mn |
|---|---|---|---|---|---|---|
| HB 320 | 4.3-5.6 | 0.3-0.45 | 1.5-2 | 3.3-3.45 | 1.8-2 | 0.3-0.6 |
| HB 330 | 4.6-5.9 | 0.3-0.45 | 1.5-2 | 3.3-3.45 | 1.8-2 | 0.3-0.6 |
| HB 340 | 4.7-6 | 0.3-0.45 | 1.5-2 | 3.3-3.45 | 1.8-2 | 0.3-0.6 |
| HB 350 | 4.8-6.1 | 0.35-0.5 | 1.5-2 | 3.3-3.45 | 1.8-2 | 0.3-0.6 |
| HB 360 | 4.9-6.2 | 0.35-0.5 | 1.5-2 | 3.3-3.45 | 1.8-2 | 0.3-0.6 |

A second aspect of the invention is the method for manufacturing a part in an alloy according to the invention.

First of all, the part is cast into a mold.

Once the part is cast, it undergoes cooling, notably slow cooling, in its mold, notably until ambient temperature (<50° C.). The part is then subject to a heat treatment. The term of « slow» means less than 100° C./h, 80° C./h or 50° C./h. The slow cooling takes preferably place over the whole cooling period.

The ultimate fatigue strengths are given for a calculation according to ISO 6336.

What is claimed is:

1. A part having a largest dimension of at least 2000 mm, wherein a largest axial thickness of the part is at least 550 mm, said part being made of a spheroidal graphite cast iron alloy, said alloy comprising, in % by weight to a total weight of the alloy, in addition to addition elements, the following elements:

nickel (Ni) between 3.5% and 7%, copper (Cu) between 0.5% and 3%, molybdenum (Mo) between 0.15 and 1%, and the remainder being iron (Fe) and inevitable impurities;

wherein the hardness of the alloy is at least 340HB and at most 400HB, and said hardness is present throughout a thickness of the part.

2. The part according to claim 1, wherein the addition elements comprise:

carbon (C) between 2.5% and 4%, and/or silicon (Si) between 1.5% and 4.4%.

3. The part according to claim 1, wherein the addition elements comprise:

magnesium (Mg) between 0.02% and 0.1%.

4. The part according to claim 1, wherein the alloy further comprises one or more of the following components:

chromium (Cr)≤0.4%,
phosphorous (P)≤0.04% and
sulfur (S)≤0.015%.

5. The part according to claim 1, wherein the alloy comprises:
nickel (Ni) at least 4.1% and at most 6.5%.

6. The part according to claim 1, wherein the alloy comprises:
copper (Cu) at least 1% and at most 3%.

7. The part according to claim 6, wherein copper (Cu) is at least 1.5% and at most 2.2%.

8. The part according to claim 1, wherein the alloy comprises:
molybdenum (Mo) at least 0.25%.

9. The part according to claim 8, wherein molybdenum (Mo) is at most 0.8%.

10. The part according to claim 8, wherein molybdenum (Mo) is at most 0.5%.

11. The part according to claim 1, wherein the part is a gear rim.

12. The part according to claim 1 wherein the part is selected from the group consisting of a cogwheel, a gear rim, a gear wheel and a gear crown, said part comprising spheroidal graphite cast iron alloy according to claim 1.

13. The part according to claim 1, wherein the part is a cogwheel.

14. The part according to claim 1, wherein the largest axial thickness is the width of a tooth.

15. The part according to claim 1, wherein the part has an outer diameter of at least 3000 mm.

16. The part according to claim 1, wherein the part has an outer diameter of at least 6000 mm.

17. The part according to claim 1, wherein molybdenum is at least 0.8%.

18. A method for manufacturing the part according to claim 1, comprising:
casting a rough casting blank of the alloy into a mold, and
letting the rough casting blank cool in the mold, thus obtaining the part, wherein said letting the casting blank cool comprises slowly cooling the part, wherein the slowly cooling takes place until ambient temperature.

19. The method according to claim 18, wherein the rough casting blank is heat treated.

20. The method according to claim 19, wherein the rough casting blank is heat treated by tempering.

21. The method according to claim 18, wherein said slowly cooling the part takes place less than 100° C/h.

22. The method according to claim 18, wherein said slowly cooling the part takes place less than 80° C/h.

23. The method according to claim 18, wherein said slowly cooling the part takes place less than 50° C/h.

24. The method according to claim 18, wherein the slowly cooling takes place until ambient temperature over the whole cooling period.

25. A part having a largest dimension of at least 2000 mm, wherein a largest axial thickness of the part is at least 150 mm, said part being made of a spheroidal graphite cast iron alloy, said alloy comprising, in % by weight to a total weight of the alloy, in addition to addition elements, the following elements:
nickel (Ni) between 3.5% and 7%,
copper (Cu) between 0.5% and 3%,
molybdenum (Mo) between 0.15 and 1%, and
the remainder being iron (Fe) and inevitable impurities;
wherein the hardness of the alloy is at least 340HB and at most 400HB, and said hardness is present throughout a thickness of the part, wherein the part comprises ≤1% manganese (Mn).

26. The part according to claim 25, wherein manganese (Mn) is below 0.8%.

27. A part having a largest dimension of at least 2000 mm, wherein a largest axial thickness of the part is at least 150 mm, said part being made of a spheroidal graphite cast iron alloy, said alloy comprising, in % by weight to a total weight of the alloy, in addition to addition elements, the following elements:
at least 4.8% and at most 5.8% nickel (Ni),
copper (Cu) between 0.5% and 3%,
molybdenum (Mo) between 0.15 and 1%, and
the remainder being iron (Fe) and inevitable impurities;
wherein the hardness of the alloy is at least 340HB and at most 400HB, and said hardness is present throughout a thickness of the part.

* * * * *